United States Patent [19]

Clifford

[11] 4,326,893

[45] Apr. 27, 1982

[54] IMPLEMENT AND METHOD FOR CLEANING TUBULAR DRAINS

[75] Inventor: Jack R. Clifford, Alton, Ill.

[73] Assignees: Paul L. Pratt, Bethalto; John T. Pierce, Jr., Edwarsville, both of Ill. ; part interest to each

[21] Appl. No.: 168,727

[22] Filed: Jul. 14, 1980

Related U.S. Application Data

[63] Continuation-in-part of Ser. No. 42,548, May 25, 1979, Pat. No. 4,218,803.

[51] Int. Cl.[3] ..... B08B 9/04

[52] U.S. Cl. ..... 134/8; 15/104.05; 15/104.3 R; 134/22.11; 134/24

[58] Field of Search ..... 15/104.05, 104.3 R; 134/167 C, 22 C, 8, 24, 22.11, 22.12

[56] References Cited

U.S. PATENT DOCUMENTS

| | | | |
|---|---|---|---|
| 202,519 | 4/1878 | Chapin | 15/104.3 R |
| 494,427 | 3/1893 | Lacroix et al. | 15/104.3 R |
| 1,568,392 | 1/1926 | Abernathy | 15/104.3 R |
| 1,733,512 | 10/1929 | Parker | 15/104.3 R |
| 1,972,402 | 8/1934 | Jones | 15/104.3 R |
| 2,328,093 | 8/1943 | Osborn et al. | 15/104.3 R |
| 3,600,225 | 8/1971 | Parmelee | 134/22 C |
| 4,085,474 | 4/1978 | Murphy | 134/167 C |
| 4,216,561 | 8/1980 | Clifford | 15/104.3 R |
| 4,218,803 | 8/1980 | Clifford | 15/104.3 R |

FOREIGN PATENT DOCUMENTS

| | | | |
|---|---|---|---|
| 368434 | 5/1963 | Switzerland | 15/104.3 R |

*Primary Examiner*—S. Leon Bashore
*Assistant Examiner*—Michael Goldman
*Attorney, Agent, or Firm*—Grace J. Fishel

[57] ABSTRACT

An implement for cleaning tubular drains and a method for cleaning therewith, said implement having a carriage assembly with radially extending cutting means at a forward end and a correspondingly radially extending plunger means in spaced relationship therewith at a rearward end, together with means for wetting the debris in the drain in advance of the forward passage of the plunger means, said plunger means comprising a plurality of fan shaped elements which are folded backwardly into a cone when the implement is pulled forward and which are expanded into a disc when the implement is pulled backwards.

9 Claims, 8 Drawing Figures

FIG. 3
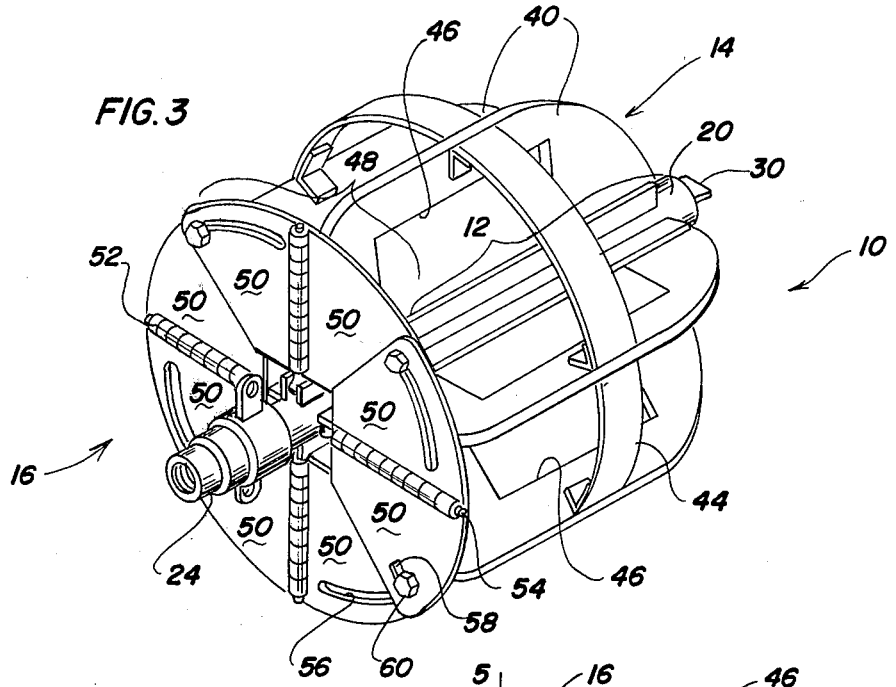
FIG. 4
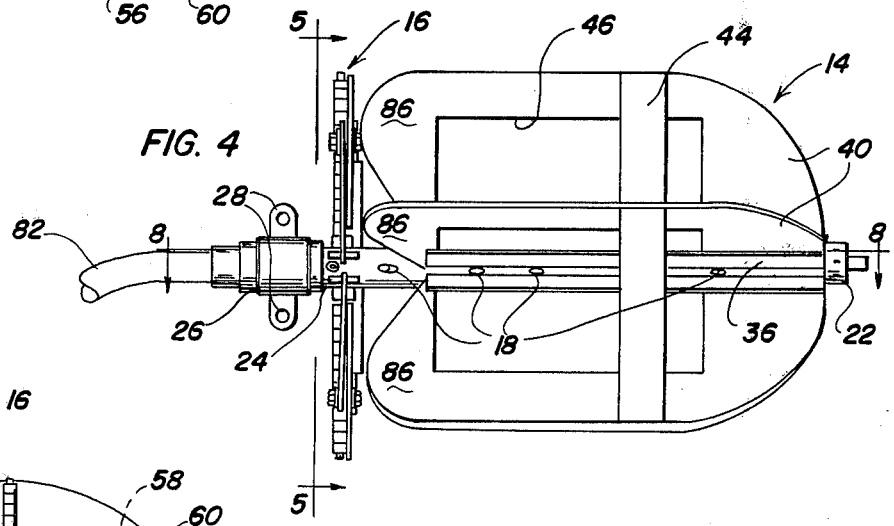
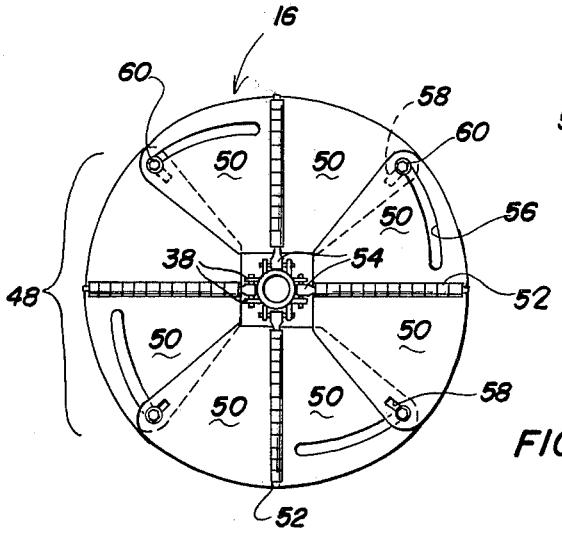
FIG. 5

FIG. 6
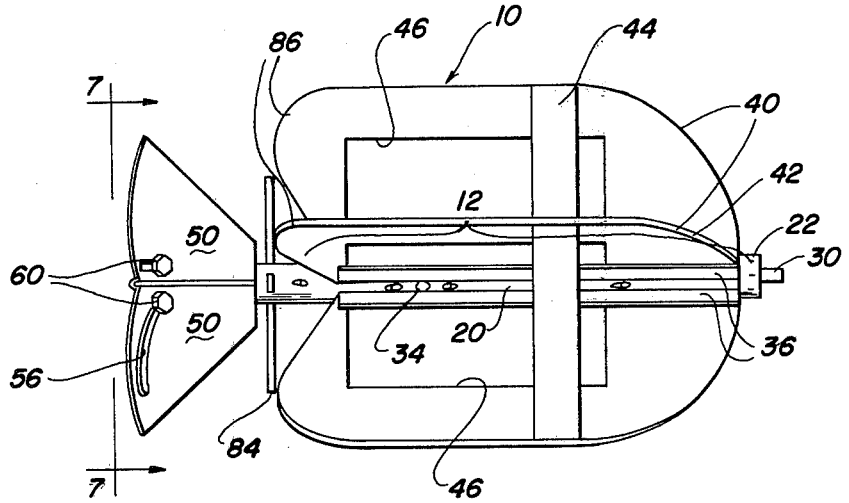
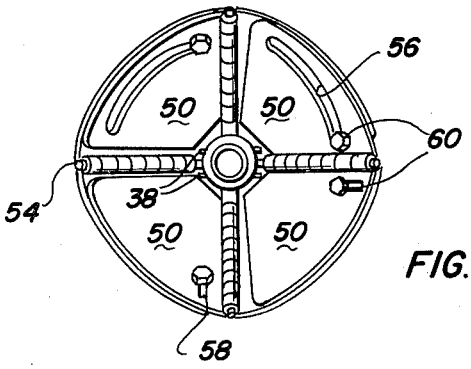
FIG. 7
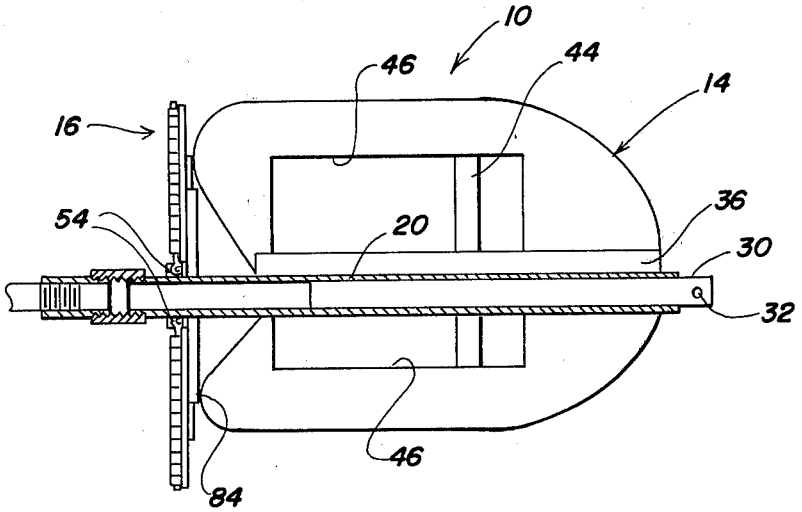
FIG. 8

IMPLEMENT AND METHOD FOR CLEANING TUBULAR DRAINS

This is a continuation-in-part of application Ser. No. 42,548 filed May 25, 1979, now U.S. Pat. No. 4,218,803, for Implement for Cleaning Tubular Culverts.

The present invention relates to an improved implement and method of cleaning tubular drains. The Disclosure Document filed June 4, 1980 relating hereto is incorporated by reference.

The apparatus as shown in the drawings of Ser. No. 42,548 has a rigid plunger means and has superior application in cleaning drains filled with silt and clay. It has been found, however, that in drains filled with loose waste material that said material builds up as a plug in front of the machine and it has been found necessary to remove this debris as it is churned loose by the implement.

In view of the above, among the several objects of the present invention may be noted the provision of an improved implement and method for cleaning tubular drains which is particularly suited to sanitary sewers or the like. Other objects and features will be in part apparent and in part pointed out hereinafter. The invention accordingly comprises the constructions and methods hereinafter described, the scope of the invention being indicated in the subjoined claims.

In the accompanying drawings, in which one of various possible embodiments of the invention is illustrated, corresponding reference numerals refer to corresponding parts and in which:

FIG. 3 is a rear perspective view of the improved implement with the plunger means fully expanded;

FIG. 4 is a side elevational view thereof;

FIG. 5 is a sectional view taken along line 5—5 in FIG. 4;

FIG. 6 is a side elevational view of the improved implement with the plunger means folded into a cone;

FIG. 7 is a sectional view taken along line 7—7 in FIG. 6; and,

FIG. 8 is a sectional view taken along line 8—8 in FIG. 4.

Figure 1:
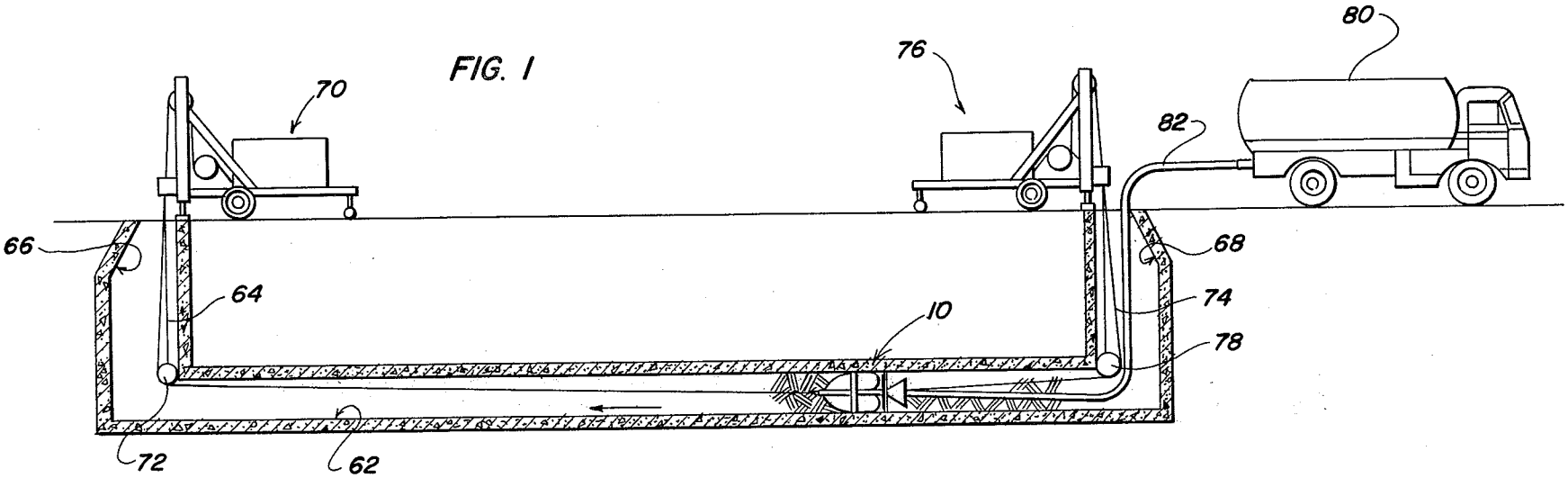
FIG. 1 is a cross-sectional view of a sanitary sewer showing the improved implement being pulled forward and with the plunger means folded into a cone.

Referring to the drawings more particularly by reference character, reference numeral 10 refers to an improved implement in accordance with the present invention. Implement 10 includes an elongated carriage assembly 12 with a cutting means 14 at its forward end and plunging means 16 in spaced relationship therewith at its rearward end. It further includes water directing means 18 for spraying water in advance of plunging means 16.

Carriage assembly 12 includes a hollow pipe 20 which is capped at its forward end 22 and is tapped (not shown) adjacent its rearward end 24 for attachment to a hose coupling. Rearward end 24 of pipe 20 is outfitted with a pinion 26 with hitching means 28 for a drag cable. Carriage assembly 12 further includes a tow bar 30 with a hole 32 adjacent its forward end for attachment to a drag cable. Tow bar 30 extends into pipe 20 and through end cap 22 and is bolted at 34 with pipe 20 to effect transfer of the pulling force from the capped end of the pipe to carriage assembly 12 back of the leading edge of cutting means 14 and in front of plunging means 16. Carriage assembly 12 further includes mounting means 36 and 38 for cutting means 14 and plunging means 16, illustrated as cradle flanges 36 and ears 38.

As illustrated in the drawings, cutting means 14 are made up of a plurality of radially projecting cutter blades 40 which are preferably spaced around the outside of pipe 20 and are mounted parallel to the longitudinal axis thereof. To provide for radial adjustment, it is preferred that blades 40 be mounted to pipe 20 by means of cradle flanges 36 which, in turn, are fixedly mounted to the pipe. Alternatively, radial adjustment may be achieved with auxiliary shoes as shown in Ser. No. 42,548. As shown in the drawings, blades 40 are elongated and, as more particularly described hereinafter, serve as runners. In addition, each of blades 40 is correspondingly sharpened along its forward end into a knife 42. A plurality of arcuate shaped plates 44 are mounted between adjacent blades 40 forming a thin band around the implement, opposite side edges of which plates are sharpened into cutting edges. In the embodiment shown in the drawings, a slot 46 is cut out of each cutter blade 40 to lighten the overall weight of the implement and to allow the debris to flow between adjacent blades. Baffle plates such as those shown in Ser. No. 42,548 may be attached to cutter blades 40 to maximize mixing of the debris between the blades and to torque the implement as it is towed.

Plunging means 16 includes a plurality of overlapping fan shaped elements 48 which are pivoted to carriage assembly 13 and are folded backwardly into a cone as shown in FIGS. 1, 6 and 7 when implement 10 is pulled forward and which are expanded into a plate having substantially the same diameter as radially extending cutter blades 40 as shown in FIGS. 2–5 and 8 when implement 10 is pulled backward. As shown, each of fan shaped elements 48 is formed from two symmetrically shaped leaves 50 joined together at corresponding edges by a piano hinge 52 having a hinge pin 54 by which elements 48 are pivoted to carriage assembly 12. More particularly, each of hinge pins 54 terminates in an eye which is journaled between spaced apart ears 38 attached to pipe 20.

As shown in the drawings, plunging means 16 is made up of four fan shaped elements 48, which number has been found highly satisfactory for cleaning sanitary sewers. If more elements 48 are used, plunging means 16 can be folded into a cone having a smaller base thus offering less resistance when the implement is towed forward. Correspondingly, fewer elements 48 give rise to a plunging means which folds into a cone with a larger base offering more resistance. When plunging means 16 is made up of four fan shaped elements 48, as best seen in FIG. 5, it is preferred that only two of the four elements be lapped in domino fashion. To accommodate the motion of elements 48, circumferential and radial slots 56 and 58 are alternately formed in leaves 50, slot 56 being angled towards the outer edge thereof and slots 56 and 58 being held in alignment on bolts 60 thus causing overlapping elements 48 to operate as a unit.

In the form illustrated, water directing means 18 comprise a plurality of water jets, preferably located in spaced apart sets between blades 40 along the length of pipe 20 and in front of plunging means 16. As best seen in FIG. 4, in the embodiment illustrated therein, water directing means 18 is made up of 27 jets, all of which may or may not be used in any one particular job. Three sets of five jets are located in the rear and are set at 45 degrees towards plunging means 16. Another set of five is set at 90 degrees in front of arcuate plates 44 which serve as root cutters and five more are formed adjacent end cap 22 at 45 degrees towards the front with two additional jets formed in the end cap.

Figure 2:
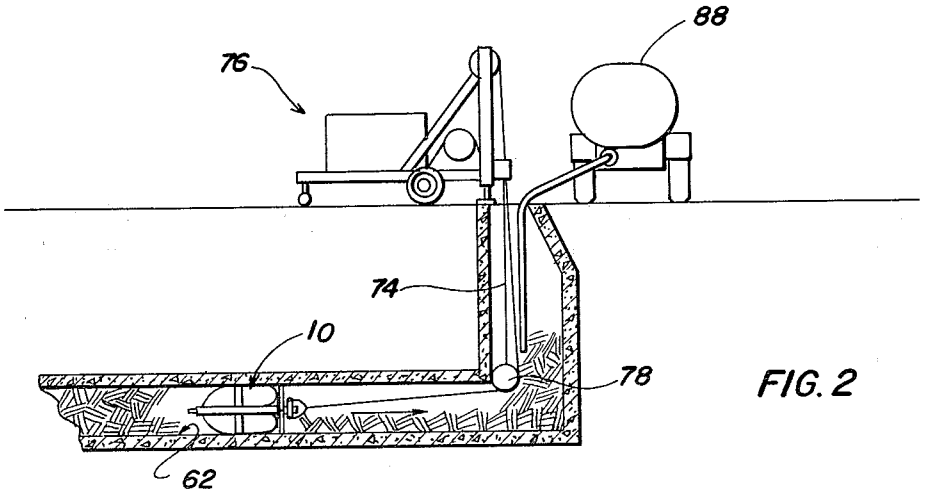
FIG. 2 is a fragmentary, cross-sectional view like FIG. 1 but showing the improved implement being pulled backward and with the plunger means expanded into a disc.

As illustrated in FIGS. 1 and 2, implement 10 can be used to clean a drain such as a sanitary sewer 62 wherein the outside diameter of the cutting means and fully expanded plunging means fits within fairly close tolerances therein. A first cable 64 is threaded through the drain. When the drain is between manholes 66 and 68, this operation is advantageously accomplished by means of a high pressure jet nozzle which is propelled by a backwards jet action through the drain.

After cable 64 is threaded through the drain, one end of it is hooked on a swivel in hole 32 of tow bar 30 while the other end is attached to a means for pulling the implement through the drain such as winch 70. To keep the direction of pull on cable 64 in-line with the drain, cable 64 is passed around a roller 72 which is anchored near the bottom of manhole 66 by means of an adjustable rod attached to winch 70. A second cable 74 is attached to hitching means 28 by means of a pair of shackles joined by a loop of cable for dragging the implement out backwards with a second means for pulling such as winch 76. As with cable 64, cable 74 is passed around a roller 78 which like roller 72 is anchored near the bottom of manhole 68 by means of an adjustable rod attached to winch 76. A source of water under high pressure such as water truck 80 is attached by means of a flexible hose 82 to implement 10 at the aforementioned hose coupling.

As shown in FIG. 1, with water spraying out of selected water directing means 18 for slurrying the waste, such others being capped, implement 10 is towed forward by winch 70. As the water is sprayed, cutting means 14 churns the debris and directs it backwardly towards plunging means 16 where the weight of it folds fan shaped elements 48 into a cone, the wide end of which opens out in a direction opposite to that in which the implement is being towed. Any tree roots or other similar obstructions will be cut loose by arcuate plates 44 which serve as root cutters.

When a selected amount of material has been churned loose and passed rearward through the implement, the direction of travel is reversed as shown in FIG. 2 and winch 76 is used to tow implement 10 backward. As implement 10 moves backwardly, the open end of the cone formed by the folded fan shaped elements becomes filled with debris exerting pressure on one or more elements 48, which force is transmitted to the other elements reversing the fold and expanding them into a plate. A number of brackets 84 are mounted to pipe 20 to give support to hinges 52 when plunging means 16 is fully expanded and to prevent elements 48 from folding into a cone in the opposite direction. The pressure on brackets 84 is relieved by cutter blades 40, by resting against heels 86 formed thereon.

When implement 10 is towed backwardly by winch 76, water directing means 18 are interrupted and the slurried waste behind the implement is drawn into manhole 68 where it wells up. A vacuum water or sludge pump truck 88 provides means for pumping the liquefied waste from manhole 68 by which it is removed from the system but other means can be used for pumping the waste such as a clam bucket or auger system. When implement 10 has returned to the mouth of sewer 62, water directing means 18 are again started and the direction of pull is reversed. This back-and-forth motion is continued until the drain is cleaned.

In view of the above, it will be seen that the several objects of the invention are achieved and other advantageous results attained. As various changes could be made in the above constructions and methods without departing from the scope of the invention it is intended that all matter contained in the above description or shown in the accompanying drawings shall be interpreted as illustrative and not in a limiting sense.

What is claimed is:

1. An implement for cleaning tubular drains, said implement comprising an elongated carriage assembly with means for cutting at its forward end and plunging means at its rearward end in spaced relationship with said cutting means, said cutting means comprising a plurality of blades radially extending from the carriage assembly, said plunging means comprising a plurality of fan shaped elements pivoted to said carriage assembly and folded backwardly into a cone when the implement is pulled forward and expanded into a plate when the implement is pulled backward, said fan shaped elements being connected as a unit whereby pressure on one or more of said fan shaped elements is transmitted to the other fan shaped elements so that said fan shaped elements close into a cone and expand into a plate as a unit, said implement further including arcuate root cutting blades joining adjacent ones of the radially extending blades and water directing means for spraying water in front of the plunging means.

2. The implement of claim 1 wherein the plunging means have substantially the same diameter as the radially extending cutting means.

3. The implement of claim 2 wherein each of the fan shaped elements is formed from two symmetrically shaped leaves joined together at corresponding edges by a hinge having a hinge pin by which the fan shaped elements are pivoted to said carriage assembly.

4. The implement of claim 3 wherein the fan shaped elements are overlapping when expanded into a plate.

5. The implement of claim 4 wherein overlapping portions of adjacent fan shaped elements are linked together by means which accommodate the arcuate motion of said fan shaped elements when they are pivoted on said carriage assembly.

6. The implement of claim 5 wherein support means mounted to the carriage assembly support the hinges when the plunging means are expanded into a plate.

7. The implement of claim 6 wherein the cutting means provide auxiliary support for the hinges when the plunging means are expanded into a plate.

8. A method for cleaning tubular drains containing waste which comprises towing an implement comprising an elongated carriage assembly with means for cutting at its forward end and plunging means at its rearward end in spaced relationship with said cutting means, said cutting means comprising a plurality of blades radially extending from the carriage assembly, said plunging means comprising a plurality of fan shaped elements pivoted to said carriage assembly and folded backwardly into a cone when the implement is pulled forward and expanded into a plate when the implement is pulled backward, said fan shaped elements being connected as a unit whereby pressure on one or more of said fan shaped elements is transmitted to the other fan shaped elements so that said fan shaped elements close into a cone and expand into a plate as a unit, said implement further including arcuate root cutting blades joining adjacent ones of the radially extending blades, said implement further including water directing means for spraying water in front of the plunging means, pulling said implement in a forward direction and for a selected distance with water flowing out of the water directing means whereby the waste in the drain is churned loose by the cutting means, worked into a slurry and passed around the plunging means; said method further including towing the implement in an opposite direction after said selected distance has been reached, as said implement is towed backwardly, the open end of the fan shaped elements which are folded backwardly into a cone fills with loose waste material exerting pressure on one or more of said fan shaped elements, which force is transmitted to the other elements reversing the fold and expanding them into a plate having substantially the same diameter as the tubular drain whereby the waste churned loose by the cutting means, worked into a slurry and passed around the plunging means is swept backward by the fully expanded plunging means as the implement is towed backwards.

9. The method of claim 8 which further includes pumping the slurried waste from the tubular drain while said implement is towed backwards.

* * * * *